US010314157B1

(12) United States Patent
Carlsten et al.

(10) Patent No.: US 10,314,157 B1
(45) Date of Patent: Jun. 4, 2019

(54) RESONANT KLYNAC (COMBINED KLYSTRON AND LINAC IN A BI-RESONANT STRUCTURE)

(71) Applicant: Los Alamos National Security, LLC, Los Alamos, NM (US)

(72) Inventors: Bruce Carlsten, Los Alamos, NM (US); Kimberley Nichols, Los Alamos, NM (US)

(73) Assignee: TRIAD NATIONAL SECURITY, LLC, Los Alamos, NM (US)

( * ) Notice: Subject to any disclaimer, the term of this patent is extended or adjusted under 35 U.S.C. 154(b) by 0 days.

(21) Appl. No.: 15/691,499

(22) Filed: Aug. 30, 2017

Related U.S. Application Data

(60) Provisional application No. 62/383,879, filed on Sep. 6, 2016.

(51) Int. Cl.

| | |
|---|---|
| ***H05H 7/08*** | (2006.01) |
| ***H01J 25/10*** | (2006.01) |
| ***H05H 7/22*** | (2006.01) |
| ***H05H 7/18*** | (2006.01) |

(52) U.S. Cl.
CPC ..... *H05H 7/08* (2013.01); *H01J 25/10* (2013.01); *H05H 7/18* (2013.01); *H05H 7/22* (2013.01); *H05H 2007/084* (2013.01); *H05H 2007/225* (2013.01)

(58) Field of Classification Search
CPC .... H05H 7/08; H05H 7/18; H05H 7/22; H01J 25/10
USPC ..... 315/505, 506, 502
See application file for complete search history.

(56) References Cited

U.S. PATENT DOCUMENTS

| | | | | |
|---|---|---|---|---|
| 3,274,430 | A * | 9/1966 | El-Hefni | H01J 25/20 315/5.41 |
| 3,811,065 | A * | 5/1974 | Lien | H01J 25/10 315/5.39 |
| 6,448,722 | B1 * | 9/2002 | Yu | H05H 7/08 250/423 P |
| 8,405,056 | B2 * | 3/2013 | Amaldi | A61N 5/10 250/396 R |
| 2009/0302785 | A1 * | 12/2009 | Miller | H05H 7/22 315/505 |
| 2010/0060208 | A1 * | 3/2010 | Swenson | H05H 7/02 315/505 |
| 2011/0188638 | A1 * | 8/2011 | Treas | H05H 7/02 378/137 |

(Continued)

FOREIGN PATENT DOCUMENTS

| | | |
|---|---|---|
| CA | 1040309 | 10/1978 |

OTHER PUBLICATIONS

J.L. Xie et al., "A Combined Source of Electron Bunches and Microwave Power,", Review of Scientific Instruments, vol. 74, No. 12, Dec. 2003, pp. 5053-5057.

(Continued)

*Primary Examiner* — Douglas W Owens
*Assistant Examiner* — Syed M Kaiser
(74) *Attorney, Agent, or Firm* — Lewis Roca Rothgerber Christie LLP

(57) ABSTRACT

Provided is a klynac including: a klystron input cell configured to form a first resonant circuit; a klystron output cell; and a plurality of linac cells configured to form a second resonant circuit with the klystron output cell.

20 Claims, 6 Drawing Sheets

(56) References Cited

U.S. PATENT DOCUMENTS

| | | | | |
|---|---|---|---|---|
| 2012/0181928 | A1* | 7/2012 | Solomon | H01J 25/10 315/5.39 |
| 2013/0015763 | A1* | 1/2013 | Scheitrum | H01J 23/38 315/5.41 |
| 2014/0035588 | A1* | 2/2014 | Botto | E21B 47/1015 324/333 |
| 2014/0037065 | A1* | 2/2014 | Botto | H05H 9/005 378/86 |
| 2015/0057484 | A1* | 2/2015 | Amaldi | H05H 7/22 600/1 |

OTHER PUBLICATIONS

James A. Potter, et al. "The Klynac: An Integrated Klystron and Linear Accelerator," Application of Accelerators in Research and Industry, AIP Con. Proc. 1525, © 2013 AIP Publishing LLC, pp. 178-183.

* cited by examiner

RESONANT KLYNAC (COMBINED KLYSTRON AND LINAC IN A BI-RESONANT STRUCTURE)

CROSS-REFERENCE TO RELATED APPLICATION(S)

The present application claims priority to and the benefit of U.S. Provisional Application No. 62/383,879, filed Sep. 6, 2016, entitled "RESONANT KLYNAC (COMBINED KLYSTRON AND LINAC IN A BI-RESONANT STRUCTURE)", the entire content of which is incorporated herein by reference.

STATEMENT REGARDING FEDERALLY SPONSORED RESEARCH OR DEVELOPMENT

The United States government has rights in this invention pursuant to Contract No. DE-AC52-06NA25396 between the United States Department of Energy and Los Alamos National Security, LLC for the operation of Los Alamos National Laboratory.

BACKGROUND

1. Field

Embodiments of the present invention relate to a resonant Klynac (a combined klystron and linac in a bi-resonant structure).

2. Description of the Related Art

A klynac-like device was first described by Schriber in 1978 (S. O. Schriber, "Klystron-accelerator system," Canadian patent 1040309, Oct. 10, 1978), where the output cavity of a klystron formed a single resonant structure with a linac section through coupling cells (operating in the $\pi/2$ mode, so there was negligible field in the coupling cells). In Schriber's device, several of these klystron/linac sections would be concatenated to form a high-energy accelerator, with the electron beam injected from a separate electron source. More recently, in 2003, Xie (J. L. Xie et al., "A combined source of electron bunches and microwave power," Rev. Sci. Instrum., 74, 5053 (2003)) demonstrated a klynac-like device where he directly attached a linac section to the output of a klystron. Some portion of the klystron beam was used as the linac beam. A hole in the collector was followed by a bending magnet, which provided an energy filter for the klystron electrons. The radio frequency (RF) output of the klystron was externally connected to the linac section. Xie demonstrated 10 MeV acceleration with a 5 MW klystron. In 2013, Potter (J. M. Potter, D. Schwellenbach, and A. Meidinger, "The klynac, an integrated klystron and linear accelerator," presented at CAARI, Aug. 5-10, 2012, AIP Conference Proceedings 1525, 178 (2013)) designed a resonant coupling cell with the same functionality as in Schriber's concept but where the klystron and linac are collinear and a small hole would allow some fraction of the klystron electron beam to be accelerated in the linac as in Xie's device.

SUMMARY

A klynac is a combined RF source (klystron) and linear accelerator (linac). It has a primary application as a radiation source, by converting a 1 MeV or higher energy electron beam to X-rays through a tungsten converter. Embodiments of the present invention may include a klynac with two resonant circuits (i.e., all the klystron and linac cells are resonantly coupled into one of two separate circuits).

According to an embodiment of the present invention a klynac includes: a klystron input cell configured to form a first resonant circuit; a klystron output cell; and a plurality of linac cells configured to form a second resonant circuit with the klystron output cell.

The plurality of linac cells may include four linac cells. The klynac may further include a klystron gain cell configured to be a part of the second resonant circuit. The klystron gain cell may include two klystron gain cells. The klystron gain cell may include three klystron gain cells. A klystron gain cell may be configured to be a part of the first resonant circuit.

According to an embodiment of the present invention a klynac includes: a first klystron gain cell configured to form a first resonant circuit; and a second klystron gain cell, a klystron penultimate and output cell, and a plurality of linac cells configured to form a second resonant circuit.

The first klystron gain cell may also be an input cell. The first klystron gain cell may include two klystron gain cells. The second klystron gain cell may include two klystron gain cells. The klystron penultimate and output cell may include two klystron gain cells. The plurality of linac cells may include four linac cells.

According to an embodiment of the present invention a klynac includes: a plurality of klystron cells including: a klystron input cell configured to form a first resonant circuit; a klystron gain cell; and a klystron output cell; and a plurality of linac cells configured to form a second resonant circuit with the klystron gain cell and the klystron output cell.

The plurality of klystron cells may have a gap length smaller than a length of coupling cells between adjacent ones of the plurality of klystron cells. A first linac cell of the plurality of linac cells may have a different length and RF field amplitude than each of the other linac cells of the plurality of linac cells. The plurality of linac cells may have a gap length longer than a length of coupling cells between adjacent ones of the plurality of linac cells. The klynac may further include an intercepting aperture between the klystron output cell and a first linac cell of the plurality of linac cells, the intercepting aperture being configured to reduce a beam current in the plurality of linac cells. A reduction amount of the beam current may be adjustable by pinching the beam with an external magnetic field. The klynac may further include a coupling cell between the klystron output cell and a first linac cell of the plurality of linac cells, the coupling cell being a toroidal cell.

BRIEF DESCRIPTION OF THE DRAWINGS

Illustrative, non-limiting example embodiments will be more clearly understood from the following detailed description taken in conjunction with the accompanying drawings.

In these drawings, RF cells that provide the functionality of a klystron are called klystron cells, RF cells that provide the functionality of a linac are called linac cells, and cells that are used to couple the klystron and/or linac cells together into resonant circuits are called coupling cells. Coupling cells do not interact with the electron beam and will not be numbered or included in numbering of klynac, klystron, or linac cells.

DETAILED DESCRIPTION

Figure 1:
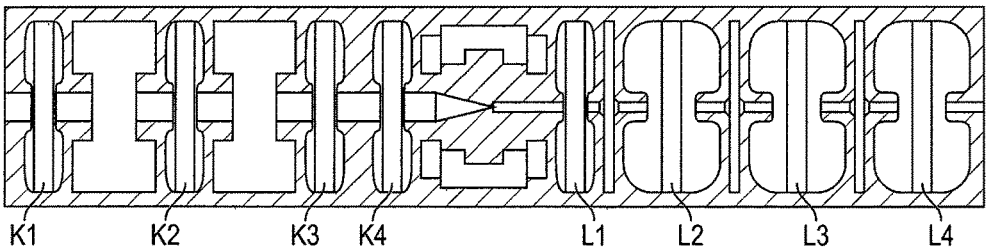
FIG. 1 illustrates a layout of an RF structure of a nominal 8-cell bi-resonant klynac of configuration A, where the first three cells form the first resonant circuit and the following five cells for the second resonant circuit.

A klynac is a combined RF source (klystron) and linear accelerator (linac). It has a primary application as a radiation source, by converting a 1 MeV or higher energy electron beam to X-rays through a tungsten converter. Embodiments of the present invention may include a klynac with two resonant circuits (i.e., all the klystron and linac cells are resonantly coupled into one of two separate circuits).

Klynac is a term that has been coined for a klystron and linear accelerator (linac) combined into a single structure. Specifically, the klystron output cell is resonantly coupled to a short linac section and some portion of the klystron beam is transported into the linac section and accelerated.

A klynac device may provide a compact and inexpensive alternative to a conventional 1 MeV or higher energy accelerator that uses a separate RF source, linac, and all the associated hardware needed for that configuration (RF windows, circulator or isolator, possibly SF6 to suppress breakdown, a second high-voltage electron gun to drive the linac, etc.). Typical applications for compact 1 MeV or higher energy electron beams are medical radiation therapy, non-destructive testing, and special nuclear material interrogation, all based on gamma-ray production from bremsstrahlung radiation from a conversion target at the end of the accelerator. For medical applications, the reduced size and weight of a klynac may significantly reduce the complexity and size of the cost-dominating gantries required for moving the radiation source about the patient. For other applications, a compact, human-portable unit may be used for field operations.

Embodiments of the present invention provide an RF power generator/accelerator architecture for a klynac.

Some klynac designs may include a standard klystron architecture, where an input cell is driven by an external, low-power RF source, and sequential gain cells are all individual resonant structures (i.e., cavities). The amplitudes of each gain cell are then driven by current modulation in the beam resulting from the amplitude of the previous cells, as a convective instability. As in conventional standing-wave linacs, the accelerator cells may be resonantly coupled. Embodiments of the present invention may have an alternative klynac architecture where the cells in the klystron section are resonantly coupled to the linac cells, and the fields build up as an absolute instability.

Because the klynac is a single structure with a single thermal mass, it may be much less sensitive to temperature variations than a system with a separate klystron and linac, as temperature variations will lead to more-or-less equivalent frequency shifts in both the klystron and linac cells. This should allow operation without using active structure temperature control.

Because a bi-resonant klynac includes (e.g., consists) of two resonant circuits, it may be much less sensitive to temperature variations than a klynac that does not resonantly couple the linac cells to the output or more klystron cells or that does not resonantly couple the klystron gain cells. A bi-resonant klynac can operate with higher average beam power than a klynac that does not resonantly couple the linac cells to the output or more klystron cells or that does not resonantly couple the klystron gain cells without using active structure temperature control.

There may be at least two separate bi-resonant klynac coupling schemes: (A) the klystron input and gain section form one resonant circuit and the klystron output cell and the linac cells form a second resonant circuit (a bi-resonant structure); and (B) the klystron input cell forms one resonant circuit by itself and the rest of the klystron cells and the linac cells form a second resonant circuit (another bi-resonant structure). As shorthand these two architectures will be referred to as configuration A and configuration B, respectively. In all cases, the resonant circuits are coupled in a $\pi/2$ mode.

A klynac with a single resonant circuit (a mono-resonant klynac, where all the klystron and linac cells are part of a single resonant circuit) is unstable (the fields in the cells will never build up), but the two configurations (configurations A and B) may turn on stably. A mono-resonant klynac will not turn on because the electron beam in the linac section loads the resonant circuit too much (i.e., for small amplitudes of the RF circuit voltage, the electron beam in the linac section requires more RF energy than is extracted by the klystron section). Embodiments of the present invention are directed to configurations A and B and will be discussed in further detail below.

Because the cells are coupled in the $\pi/2$ mode, the coupling cells may have negligible RF fields and may not interact with the electron beam. Their interaction may be further suppressed by adjusting the length of their gaps to minimize their gap modulation coefficient. Because the coupling cells do not interact with the electron beam they may not be numbered or included in numbering of klynac, klystron, or linac cells. Additionally, RF cells that provide the functionality of a klystron will be called klystron cells and RF cells that provide the functionality of a linac will be called linac cells.

The klystron section of a bi-resonant klynac may resonate in the $\pi/2$ standing-wave mode which may substantially ensure (i.e., ensure) that successive klystron cells may be 180° out of phase with the previous cell, but the amplitudes can be designed to increase (i.e., to maximize) the extraction power. The klystron section cell amplitudes may be adjusted in the klynac design through the sizes of the coupling slots between the cells.

The linac section of a bi-resonant klynac may resonate in the $\pi/2$ standing-wave mode which may substantially ensure (e.g., ensure) that successive linac cells may also be 180° out of phase with the previous one. The linac section cell amplitudes may be adjusted in the klynac design through the sizes of the coupling slots between the cells.

The first linac cell may have a different length and RF field amplitude than the other linac cells.

The gap lengths of the klystron cells may be small with relatively long coupling cells between them.

The gap lengths of the linac cells may be long with relatively short coupling cell cells between them.

The separation between the klystron output cell and the first linac cell may be adjusted to optimize the bunch capture in the first linac cell.

An intercepting aperture between the klystron output cell and the linac input cell may reduce the beam current in the linac section to a small fraction of that in the klystron section. The amount of beam transmission may be adjustable by pinching the beam with an external magnetic field.

The coupling cell between the klystron output cell and the first linac cell may be special because it is not open to the axis (e.g., it may be a toroidal cell instead of a pillbox cell).

Once the beam reaches the second linac cell, it may be relativistic. Thus the separation between second and subsequent linac cells may be close to half the free-space wavelength of the klynac's operating frequency. Standard high-shunt impedance linac cell designs may be used.

Both the gap in the first linac cell and the center-to-center separation of the first and second linac cells may be shortened to provide for better capture of the initially low energy electron beam injected into the linac section.

The klynac power balance for a klynac with n linac cells can be approximated in some embodiments by equation (1), $$0 = \eta I_0 V_0 - (n - 1 + \varepsilon^2)\frac{V_L^2}{Z_L} - (n - 1 + \varepsilon) I_L T_L V_L \tag{1}$$

where $I_0$ and $V_0$ are the klystron section beam voltage and current, $\eta$ is the RF power conversion efficiency of the klystron section, c is the relative RF field amplitude of the first linac cell relative to the other linac cells, $I_L$ is the electron beam current in the linac section, $T_L$ is the transit-time factor for the linac cells, $V_L$ is the voltage of the linac cells (defined as the instantaneous line integral of $E_Z$ on axis), and $Z_L$ is the cavity impedance of the linac cells. For this formula, the accelerator community convention of cavity impedance instead of the RF source community convention is used and the amplitude of all linac cells except for the first one is assumed to be the same.

Equation (1) states that power balance is established when the RF power generated in the klystron section is equal to the RF power dissipated in the linac cells and the RF power that goes into the electron beam. Roughly speaking, the device may have about half the power going into the RF losses and half into the beam. According to other embodiments, when much less than half of the power goes into RF losses, the overall length can be shortened by increasing the gradient without much performance degradation, and when much less than half of the power goes into the beam, the beam power can be increased without a significant increase in overall length.

The RF power generation part of the klystron section in particular may have similarities with extended interaction klystrons (EIKs), where the output cavity comprises (e.g., consists of) multiple separated gaps, typically either in the 0 or $\pi$ mode. EIKs often have separated output gaps to help reduce gap breakdown and also to provide some bunching while the power is being extracted to increase the overall extraction efficiency.

FIG. 1 illustrates a layout of an RF structure of a nominal 8-cell bi-resonant klynac of configuration A. The klystron gain cells are K1, K2, and K3 and are resonantly coupled. An electron gun may be bolted on the left of K1. Although in the location of a conventional input cell, K1 shares the functionality of a gain cell. As such, cells K1 through K3 can be referred to as gain cells. There may or may not be an input RF signal drive which may be used to drive any of the gain circuit cells. The klystron output cell is K4, and the four linac cells are L1 through L4, and these five cells are also resonantly coupled. Configuration A embodiment is not limited to four klystron cells or four linac cells and may have less or more of each.

Compared to the klynac of FIG. 1, conventional klystrons typically have more individual gain cells that serve two purposes: first, there are several cells tuned close to resonance to bring the small-signal input modulation to large-signal modulation; second, there are a few cells operating with voltages at a significant fraction of the electron beam voltage that optimize the electron bunching for power extraction in the output cell (often called penultimate cells). In a configuration A design, the fields may build up in the gain cells as an absolute instability, and they may naturally attain high cell gap voltage amplitudes. Thus, several leading gain cells may not be needed to bring the modulation to a large signal.

Embodiments of the present invention may maintain a $\pi$ phase variation between cells K1, K2, and K3. The gap voltages of K2 and K3 may be very nearly $\pi/2$ out of phase with the harmonic current at those locations to keep the power transfer low.

Embodiments of the present invention may use an initial value for the gap voltage of K1 typical of voltages at the start of the penultimate region in klystrons and may locate K2 where the harmonic current is nearly $\pi/2$ out of phase with the klystron gain circuit amplitude.

According to embodiments of the present invention, the location of K3 may be such that there is at a slight decelerating phase of the RF for the harmonic current at low RF amplitudes and at a slight accelerating phase of the RF at high RF amplitudes, which approaches being $\pi/2$ out of phase as the amplitude increases. This may substantially ensure (e.g., ensure) that a stable operating point is achieved.

There may be some small second order power transfer due to finite beam impedance and additional minor RF ohmic losses in the klystron section gain cells, which may lead to shifts in their axial locations. K2 and K3 may be initially separated by the same amount as between K1 and K2 and then the locations may be tweaked to achieve stability so there may be more power extracted from the beam than needed to compensate for Ohmic losses when the circuit's RF amplitude is below the design point, and there may be less power when the amplitude is above the design point.

Figure 2:
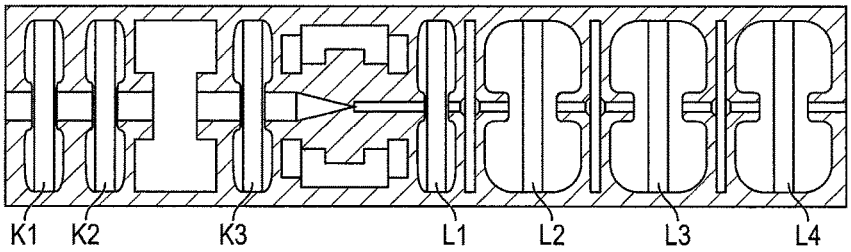
FIG. 2 shows a second bi-resonant design of configuration B, where the input cell alone forms the first resonant circuit.

FIG. 2 shows a second bi-resonant design of configuration B where the input cell alone forms the first circuit. This design is a modification to the mono-resonant klynac, where now the input cell amplitude does not get loaded by the beam loading in the linac section. The frequency for the drive of the low Q input cell may follow the second circuit's resonant frequency using low-level RF control, reducing the possibility of frequency wandering and mismatch as the device's temperature changes.

Referring back to FIG. 1, the klystron section in the configuration A klynac may have five cells total—three klystron cells and two coupling cells. As such, it has five modes, with 0, $\pi/4$, $\pi/2$, $3\pi/4$, and $\pi$ phase shift between cells. This device may turn on in the $\pi/2$ mode and not in the other modes because the phase relationship of the cells and the harmonic currents are different for each mode.

This problem is simplified if the interaction of the electron beam with the coupling cells is minimized by proper adjustment of the coupling cell gaps or by making the coupling cells coaxial like the coupling cell between K4 and L1 in FIG. 1. Making the coupling cells coaxial leads to a risk of power-flow phase shift that needs to be stabilized by the cell's geometry, as in the coupling cell between K4 and L1 in FIG. 1, which adds unnecessary complexity.

The gap between the nose cones that will minimize the coupling cells' gap modulator factor can be found using the following representative form for the electric field between the noses (equation (2)), $$E(z) = \frac{V_{gap}}{\pi d/2}\left(1 - \left(\frac{z}{d/2}\right)^2\right)^{-1/2} \tag{2}$$

where d is the distance between the nose cones and z is zero right between them. Equation (2) may capture the field divergence near knife edge nose cones, and may be representative. Integrating this expression across the gap, the gap modulation factor as function of radial position is found to be equation (3), $$T(r) = J_0(\beta_e d/2) J_0(k_0 a) \frac{I_0(k_0 r/\gamma_b \beta_b)}{I_0(k_0 a/\gamma_b \beta_b)} \tag{3}$$

defining $\beta_e = \omega(c\beta_b)$ and where a is the beam pipe radius, $k_0 = \omega/c$, $\beta_b$ and $\gamma_b$ are the beam's normalized velocity and relativistic mass factor, respectively, and d is the nose cone separation. This term can be made arbitrarily small by adjusting d so $\beta_e d/2$ approaches a zero of the $J_0$ Bessel function. As an example, this occurs for a gap of about 2 cm at about 3 GHz. If the gap is made is too long, the gap by itself may become a monotron oscillator (and extract power from the beam by itself).

The fields in the klystron cells are identical between the 0 and $\pi$ modes and also between the $\pi/4$ and $3\pi/4$ modes, so by minimizing the transit time factors of the coupling cells, there are effectively only two modes competing with the desired $\pi/2$ mode, are which may be suppressed through the axial layout of the klystron section design.

Oscillations from higher frequency modes can be eliminated with a large enough beam-pipe radius so they are not cut off and by placing RF absorptive material in the beam pipe. For example, a 2.3-cm-radius beam pipe has a cutoff frequency of 5 GHz, and may be used to suppress the higher-order modes in a 3 GHz klynac.

A configuration B klynac, according to FIG. 2, may not have any mode competition issues because it acts like a mono-resonant klynac for all modes except for one driven by the input cell, thus all modes except for the one driven by the input cell will not build up.

A klynac may minimize the temperature tolerance requirements. It is worth considering the effect of temperature fluctuations for each of the three configuration types. Errors in the relative amplitudes of cells coupled resonantly in a $\pi/2$ mode may vary as the square of dimensional deviations of the cells themselves. For copper, the deviation is about 10 parts in a million per degree C. This lets the klynac support a very large temperature gradient from one end of a resonant circuit to the other without degradation.

For example, the relative expansion of copper between one end at room temperature (20° C.) and the other at the melting point of copper (1085° C.) is just over 1% and will only lead to a 0.01% shift in the cells' relative amplitudes (but about a 0.5% percent shift in the frequency of the $\pi/2$ mode). The frequency shift should not be an issue for configuration B designs because the input cell for the configuration B design can have a low enough loaded Q value to accommodate a large frequency range.

However, this may be an issue for a configuration A design if the frequency Q-width of the gain section doesn't overlap the Q-width of the output cell/linac section. In rough numbers, the loaded gain circuit Q and the loaded output cell/linac circuit Q are about 1,000 and 10,000, respectively, which implies that the average temperature difference between the two circuits should not exceed about 100° C.

Because the gain circuit in a configuration A klynac and the input cell in a configuration B klynac both have a lower Q than that of the linac circuit by about an order of magnitude, the frequency of the gain circuit can wander away from the frequency of the linac circuit. Embodiments of the present invention may sample the linac circuit resonant frequency and then control the gain circuit frequency with an external drive.

As an illustrative example, Table I shows parameters for a specific embodiment of a 1 MeV klynac. Specifically, 160 kW of RF power at 2.856 GHz is generated using a 50 kV, 10 A beam (a conservative 32% extraction efficiency), with linac cell voltages of 40 kV for L1 and 440 kV for L2-L4, a linac beam current of 0.09 A, a linac cell impedance of 8.5 MΩ, and a linac cell transit time factor of 0.8. Approximately 69 kW of RF power is dissipated in the linac cells and about 91 kW of power is transferred into the linac beam power, resulting in a final beam energy of about 1 MeV. The length of the linac section of this 1 MeV klynac is about 20 cm.

TABLE I

| Nominal 1-MeV Klynac Parameters | Value |
|---|---|
| Number of linac cavities | 4 |
| Frequency | 2.856 GHz |
| RF power required | 160 kW |
| Linac cavity impedance | 8.5 MΩ |
| Linac cavity transit time factor | 0.80 |
| Linac cavity gap voltage | 440 kV |
| Linac electron beam current | 0.09 A |
| RF power dissipated in linac section | 69 kW |
| RF power into beam power | 91 kW |
| Final beam energy | 1.00 MeV |

As a second illustrative example, Table II shows parameters for a specific embodiment of a 6 MeV klynac. Specifically, 1860 kW of RF power at 2.856 GHz is generated using a 129 kV, 46 A beam (using a conservative 32% extraction efficiency), with linac cell voltages of 375 kV for L1 and 750 kV for L2-L11, a linac beam current of 0.2 A, a linac cell impedance of 8.5 MΩ, and a linac cell transit time factor of 0.8. Approximately 662 kW of RF power is dissipated in the linac cells and about 1200 kW of power is transferred into the linac beam power, resulting in a final beam energy of about 6 MeV. The length of the linac section of this 1 MeV klynac is about 53 cm.

TABLE II

| Nominal 6-MeV Klynac Parameters | Value |
|---|---|
| Number of linac cavities | 11 |
| Frequency | 2.856 GHz |
| RF power needed | 1.86 MW |
| Linac cavity impedance | 8.5 MΩ |
| Lilac cavity transit time factor | 0.80 |
| Linac cavity gap voltage | 750 kV |
| Linac electron beam current | 0.2 A |
| RF power dissipated in linac section | 662 kW |
| RF power into beam power | 1.2 MW |
| Final beam energy | 6.0 MeV |

Table III shows the electron beam parameters for the electron guns needed for the klynacs with parameters from Tables I and II, both at a conservative 32% extraction efficiency and a 50% extraction efficiency, which may be likely with design optimization.

TABLE III

| | Value |
|---|---|
| 160 kW Klystron Parameters | |
| Efficiency | 32% |
| Voltage | 47.8 kV |
| Current | 10.5 A |
| 160 kW Klystron Parameters | |
| Efficiency | 50% |
| Voltage | 40.0 kV |
| Current | 8.0 A |
| 1.9 MW Klystron Parameters | |
| Efficiency | 32% |
| Voltage | 128.6 kV |
| Current | 46.1 A |
| 1.9 MW Klystron Parameters | |
| Efficiency | 50% |
| Voltage | 107.6 kV |
| Current | 35.3 A |

The numerical modeling of the klynac was done with the particle-in-cell, finite-different time domain numerical model TUBE. In the following simulations, the beam transport in the klystron, aperture, and linac sections were modelled. The RF field profiles from SUPERFISH were externally imported and the cell gap amplitudes were iterated by hand when needed in order to match the required phase relationships. The klystron circuit model in TUBE is based on Ramo's circuit theory for induced current.

100 radial emission points were used for initiating the 50 kV, 10 A, 0.5 cm radius electron beam and about 41,000 simulation particles were used in the following simulations. All RF cells used the same SUPERFISH field map, with a transit time of about 0.80.

Figure 3:
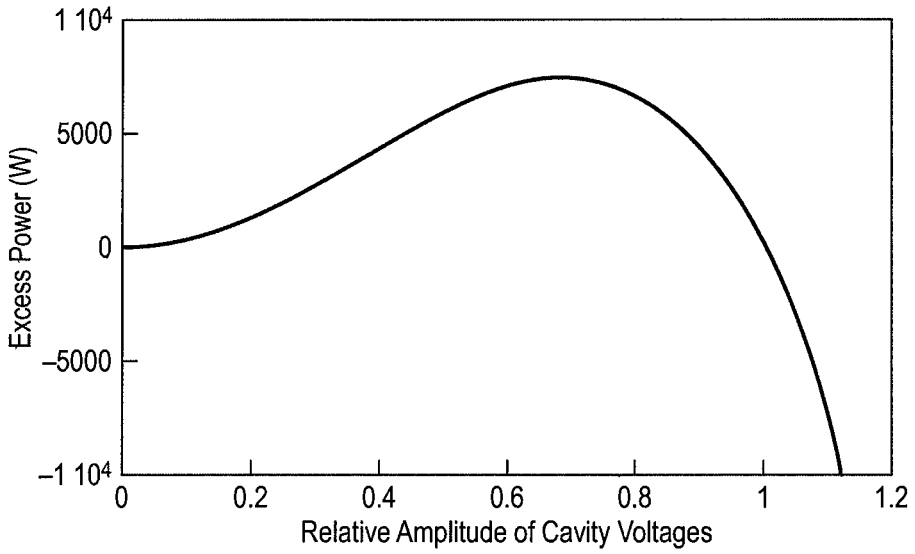
FIG. 3 is a graph of excess RF power generated by the gain resonant circuit, as a function of cell voltage amplitudes relative to the design amplitudes for the configuration A klynac shown in FIG. 1

Referring to FIG. 1, according to a specific embodiment of the present invention, a configuration A klynac may have cell amplitudes of 7.5 kV, 9.94 kV, and 54.7 kV for K1, K2, and K3, respectively, and may have axial center-to-center separations of 6.2 cm between K1 and K2 and 6.1 cm between K2 and K3. For the nominal operating parameters, the electron beam power exchange may be −860 W, −331 W, and 967 W with cells K1, K2, and K3, respectively, where a negative sign indicates that the beam absorbs RF power. This design may be stable and the gain section circuit will ring up, as shown in FIG. 3. If the gain cell amplitudes are below the design point, the beam will generate excess power, increasing the cell amplitudes. If the gain cell amplitudes are above the design point, the beam will extract power from the cells, decreasing their amplitudes.

For the specific embodiment of a configuration A klynac as shown in FIG. 1, competing modes may not turn on. By adjusting the coupling cell gaps, the transit time factors may vanish and their interaction with the electron beam may be made negligible. In that case, for a klystron-gain circuit amplitude corresponding to a K1 voltage of 100 V, the 0 and π modes require 0.64 W of additional power to maintain this field amplitude and the π/4 and 3π/4 modes require 13.3 W of additional power to maintain this field amplitude, respectively. Without external power providing drives at the frequencies of these modes, any initial amplitude caused by the beam's shock-excitation of these modes will decay. It is worth noting that the coupling between cells varies between 1 and 4%, so the frequency of these modes are all within 2% of that of the desired π/2 mode, so the change in the phase relationships between the harmonic current and RF is about π out of phase for the 0 and π modes and π/2 out of phase for the π/4 and 3π/4 modes, which explains these results.

For the specific embodiment of a configuration A klynac as shown in FIG. 1, the klystron section may have about 37% extraction efficiency with an output cell voltage of 82 kV. The linac cells may reach voltages of about 370 kV, with a maximum beam energy of about 1 MeV. The actual linac-cell shunt impedance for this device is about 5.8 MΩ. The electron beam may be confined with a 900 G axial magnetic field.

For the specific embodiment of a configuration A klynac as shown in FIG. 1, FIG. 3 is a graph of excess RF power generated by the gain resonant circuit, as a function of cell voltage amplitudes relative to the design amplitudes.

Figure 4:
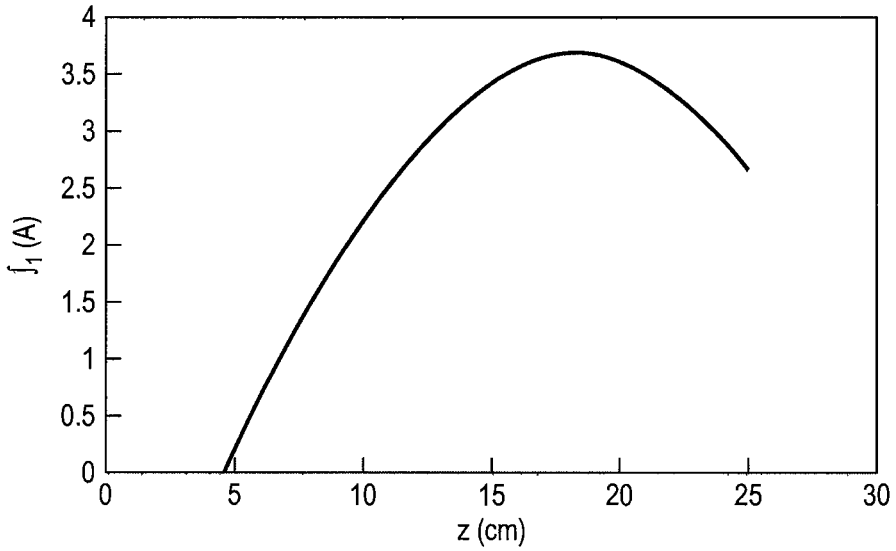
FIG. 4 is a graph showing harmonic current generated from the input cell as a function of axial position for the configuration B klynac shown in FIG. 2.
Figure 5:
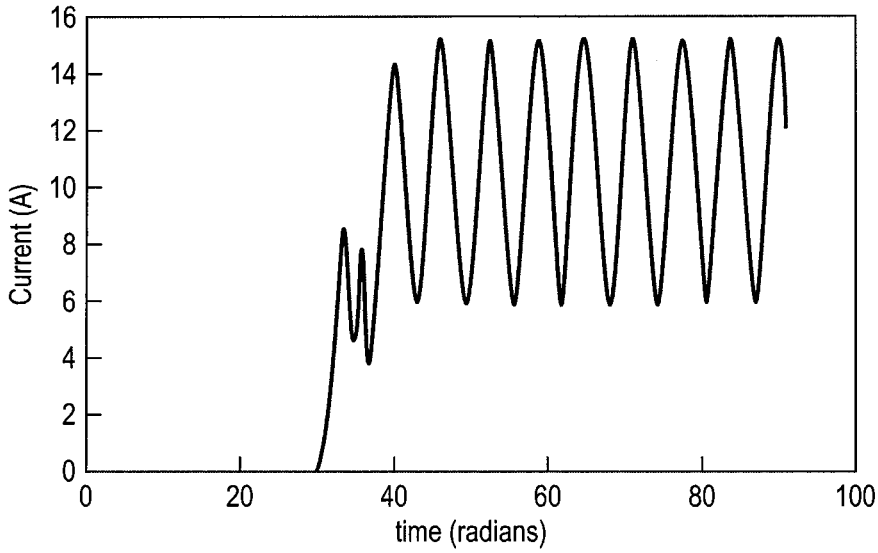
FIG. 5 is a graph showing a current profile at 14.2 cm from the center of the input cell for the configuration B klynac shown in FIG. 2.

According to another specific embodiment of the present invention, FIG. 4 is a graph showing harmonic current generated from the input cell as a function of axial position for the configuration B klynac as shown in FIG. 2. In FIG. 4, the center of the input cell is located at z=4.5 cm. FIG. 5 is a graph showing a current profile at z=18.7 cm (14.2 cm from the center of the input cell).

For the specific embodiment of a configuration B klynac as shown in FIG. 2, self-consistent modeling of the input cell showed that a drive of 500 W would generate a cell voltage of 5215 V, with a cell unloaded Q of 1000, a loaded Q of 145, and a geometric factor R/Q of 153Ω. (Most of the required RF drive power goes into beam loading.)

For the specific embodiment of a configuration B klynac as shown in FIG. 2, the maximum harmonic current due to the input cell's modulation is 3.71 A at a location of 18.7 cm. Harmonic current as a function of distance is shown in FIG. 4. The maximum may be 14.2 cm downstream from the center of the input cell. The beam current as a function of time is shown in FIG. 5. These results led to placing the second klystron cell at a location of 18.7 cm.

Figure 6:
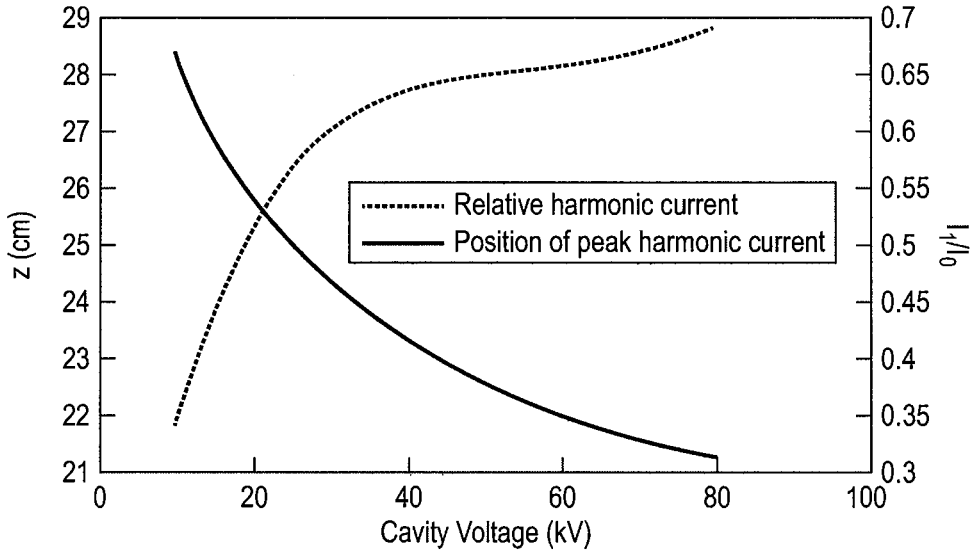
FIG. 6 is a graph of the maximum harmonic current amplitude and location as a function of the gain cell voltage of K2 for the configuration B klynac shown in FIG. 2.

For the specific embodiment of a configuration B klynac as shown in FIG. 2, K2 serves the role of a gain (or bunching) cell and K3 of an output cell in a conventional klystron. As such, the voltage of K2 and the voltage of K3 would be expected to be 90° and 180° out of phase with the beam's harmonic current and also 180° out of phase with each other. FIG. 6 is a graph of the maximum harmonic current amplitude and location as a function of the gain cell voltage of K2 and can be used to pick an initial location for K3 where the harmonic current is maximized.

Figure 7:
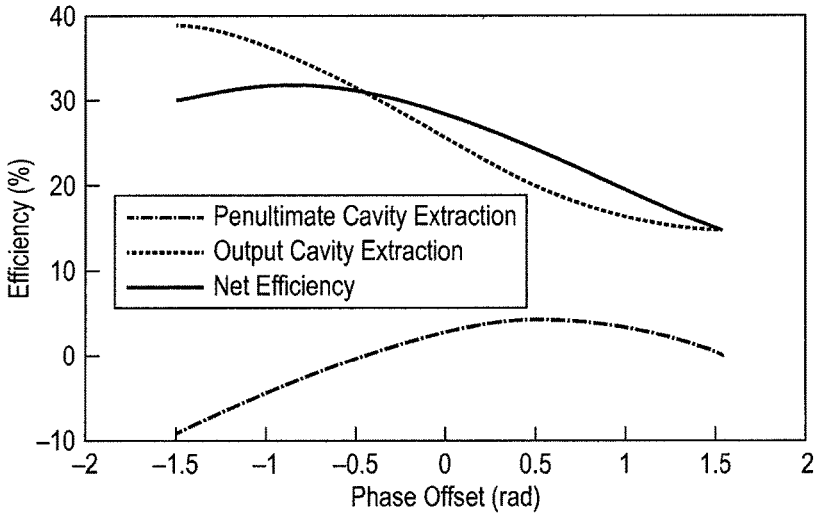
FIG. 7 is a graph showing the net efficiency of conversion from initial electron beam power to RF power in the klystron section as the separation between cells K2 and K3 is varied for the configuration B klynac shown in FIG. 2, where penultimate cell refers to K2 and output cell refers to K3.

For the specific embodiment of a configuration B klynac as shown in FIG. 2, FIG. 7 is a graph showing the net efficiency from K2 and K3 as their separation varies. FIG. 7 uses the input cell phase offset as a metric for the detuning from the initial configuration. With only K2 bunching the beam and K3 extracting power, the overall efficiency may be too low (e.g., about 14.8%) because the induced current may drop (e.g., drop to about 29.5%). To increase efficiency, the K2-K3 spacing may be shifted to increase (e.g., maximize) overall efficiency while keeping $V_{circuit}(t)$ and $i_{cav,n}(t)$ in phase. A broad efficiency maximum may be found with a phase offset of around −1.0 radians, or spacing of 23.68 cm, with an extraction efficiency of about 32%, as shown in FIG. 7.

For the specific embodiment of a configuration B klynac as shown in FIG. 2 and referring to FIGS. 6 and 7, K2 may have a voltage amplitude of 40 kV because of the knee in the harmonic current and because the harmonic current was in phase with the circuit voltage at about 23.5 cm.

For the specific embodiment of a configuration B klynac as shown in FIG. 2 the output cell (K3) may have a voltage of 60 kV to increase (i.e., maximize) output power based on the cell's transit time factor to substantially ensure (i.e., ensure) no electrons would be returned.

Power balance equation (1) may be used as a starting point for determining the linac cell voltages for the specific embodiment of a configuration B klynac as shown in FIG. 2. The ohmic power losses in K2 and K3 may be 276 W and 620 W respectively, leaving 159 kW for ohmic power losses in L1-L4 and for accelerating the beam. Scoping simulations showed that a relatively low L1 voltage (40 kV) was ideal for capturing the klystron bunch (i.e., it produced the highest harmonic current at the location where the harmonic current was in phase with the circuit voltage). Choosing an L1 voltage of 40 V in turn required L2-L4 voltages of 420 kV to achieve a 1 MeV peak beam energy. Ohmic power losses in L2-L4 are about 62 kW, leaving 98 kW for the beam, or a current of 0.098 A at 1 MeV energy.

For the specific embodiment of a configuration B klynac as shown in FIG. 2, L1 may be located such that its induced current is 3π/4 out of phase with its voltage in order to provide both acceleration and bunching. L2 and L3 may be located such that their voltages are in phase (π and 0) relative to the harmonic current at their respective locations. The location of L4 may be chosen to cancel the out-of-phase contribution to the induced current produced by L1's location. Due to the circuit's induced current scaling favorably with cell voltage and the low voltage of L1, L4 may be able to be located in very nearly the optimum location for acceleration.

Figure 8:
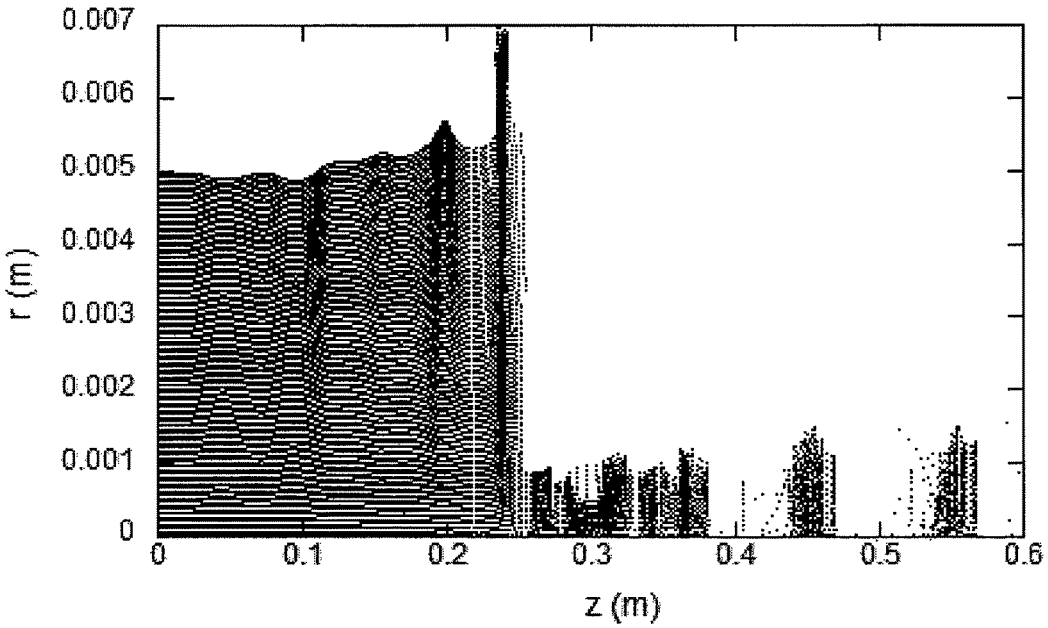
FIG. 8 is a plot of simulation particles showing their radial positions as a function of axial position for the configuration B klynac shown in FIG. 2.
Figure 9:
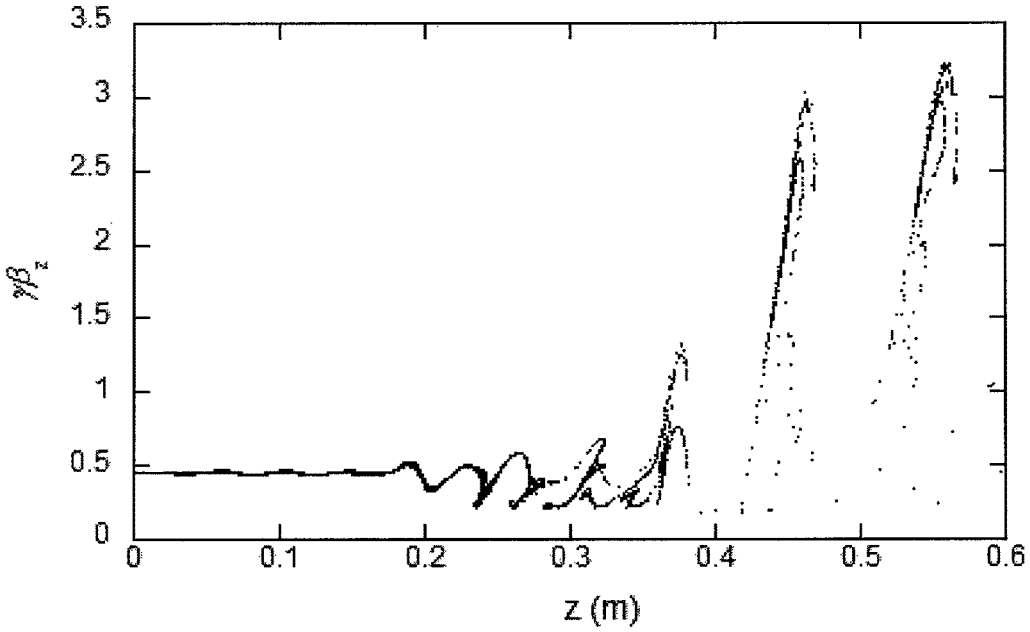
FIG. 9 is a plot of the simulated particles showing their axial momentum as a function of axial position for the configuration B klynac shown in FIG. 2.
Figure 10:
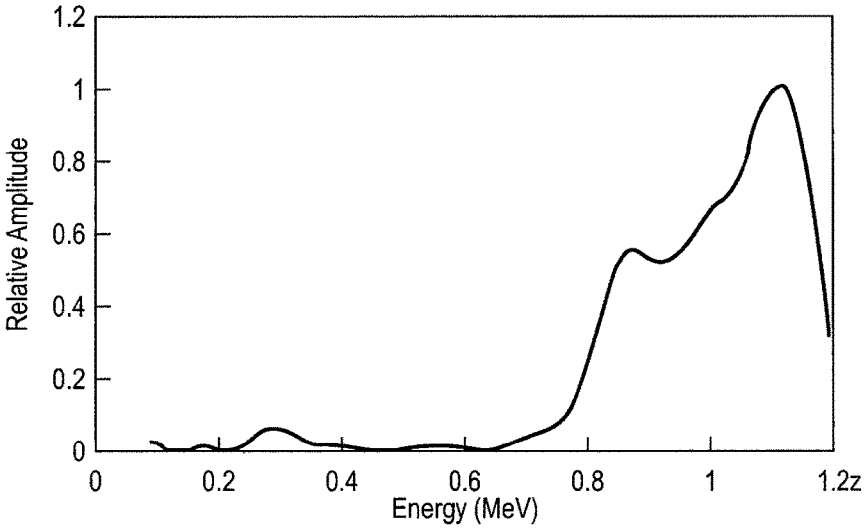
FIG. 10 is a graph of a final accelerator electron beam energy spectrum for the configuration B klynac shown in FIG. 2.

FIG. 8 is a plot of simulation particles' radial and axial positions for the specific embodiment of a configuration B klynac as shown in FIG. 2. The constricting aperture is at 25 cm, reducing the average beam current from 10 A to 0.14 A. FIG. 9 is an axial momentum plot of the simulated particles as a function of axial position. Most of the accelerated charge has energy below the peak energy gain. FIG. 10 is a graph of the final accelerated electron beam energy spectrum. The average electron energy is 0.98 MeV with an rms energy spread of 43 keV.

Referring to FIGS. 8-10, an overall plot of the beam particles radial and axial positions is shown in FIG. 8. A 1 mm aperture located at z=25 cm reduces the beam current. Even with L1 acting as a bunching cell, a large enough energy spread may be produced in the linac (see FIG. 9) so the linac can accelerate more current than initially indicated by the power balance, e.g., a total of 0.14 A with a harmonic current of about 0.18 A. L1 may be located at 29.6 cm, and L2, L3, and L4 may be located at 37 cm, 41 cm, and 45.7 cm, respectively. Note by the location of L2 in FIG. 9, excellent bunching that may be achieved by L1. The peak accelerated electron energy may be about 1.15 MeV. The final energy spectrum is shown in FIG. 10. The output rms beam size may be about 6.4 mm, with an average electron energy of 0.98 MeV with an rms energy spread of 43 keV.

For the specific embodiment of a configuration B klynac as shown in FIG. 2, the final tuned voltage for L2-L4 may be 439.5 kV, with induced currents of 0.134, 0.150, and 0.127 A, respectively. The phases of the induced current may be 2.376, −0.154, −3.114, and 0.258 radians in L1-L4, respectively.

According to embodiments of the present invention, the amplitude of the second resonant circuit may turn on from the harmonic current generated by the input cell. At steady-state, the phase of the circuit voltage and the induced current are in phase, because the second resonant circuit may be constructed to have a real impedance. As the circuit rings up, this phase relationship can be shown to be substantially the same. This enables the calculation of how much excess power is generated by the klynac at all points as the circuit amplitude rings up to verify that the circuit voltage will stably increase until the design point with a steady-state energy balance is achieved.

Figure 11:
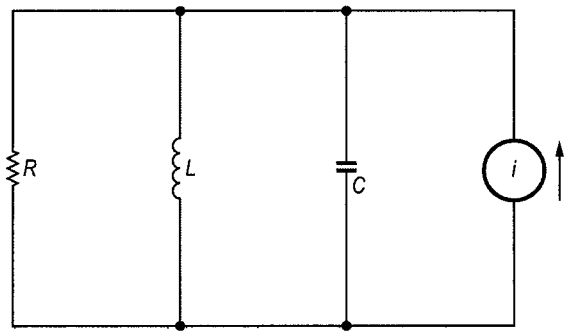
FIG. 11 is a circuit diagram of a simple cavity model used for determining the phase relationship between the current drive i and the cell voltage for the configuration B klynac shown in FIG. 2.

FIG. 11 is a circuit diagram of a simple cavity model used for determining the phase relationship between the current drive i and the cavity voltage as the configuration B klynac circuit rings up.

The circuit model in FIG. 11 shows a simple cavity driven by a constant RF current source $i=\hat{i}e^{j\omega t}$. The bi-resonant klynac may be more complicated but this equation may be solved to determine the phase relation between the induced current and the circuit voltage for this specific case as the cavity rings up to steady state. Here the steady state cavity impedance is given by equation (4), $$\frac{1}{Z_{cav}} = \frac{1}{R} + j\omega C + \frac{1}{j\omega L} = \frac{1}{R} + j\left(\frac{f}{f_0} - \frac{f_0}{f}\right)\frac{1}{R/Q} \tag{4}$$

where the second equation is using typical cavity parameters (resonant frequency $f_0$, quality factor Q, and shunt impedance R). Additionally, currents $i_R$, $i_L$, and $i_C$ running vertically through the cavity resistor, inductor, and capacitor, respectively, may be assumed. Kirchhoff's current law gives us $0=i+i_R+i_C+i_L$. This physics-based formula may be related to the circuit model above.

$$Ri_R = \frac{1}{C}\int i_C dt = L\frac{d}{dt}i_L$$

may be used. The cavity voltage in terms of the current in the resistor is $V_{cav}=Rj_R$. For a cavity tuned on resonance (as in this case), the steady state solution is $i_R=\tilde{i}_R e^{j\omega_0 t}$. It may be easy to verify that the transient solution when the current drive is turned on at t=0 to full value and with RF frequency $\omega_0$ is shown by equation (5), $$i_R=\tilde{i}_R e^{j\omega_0 t}(1-e^{\alpha t})=i(1-e^{\alpha t}) \tag{5}$$

where $$j\omega_0+\alpha=-\frac{\omega_0}{2Q}\pm j\omega_0\sqrt{1-1/4Q^2},$$

which leads to equation (6).

$$\begin{aligned} V_{cav} &= R\tilde{i}_R e^{j\omega_0 t}\left(1-e^{\left(-\frac{\omega_0}{2Q}-j\frac{\omega_0}{8Q^2}\right)t}\right) \\ &= Ri\left(1-e^{\left(-\frac{\omega_0}{2Q}-j\frac{\omega_0}{8Q^2}\right)t}\right) \end{aligned} \tag{6}$$

Note that the maximum possible phase shift between the cavity voltage and the drive may then be $$\phi_{max}\approx\frac{\omega_0}{8Q^2}\cdot\frac{2Q}{\omega_0}=\frac{1}{4Q},$$

which may be small. Also, for small times, $$t\ll\frac{\omega_0}{Q},$$

the exponentials may be expanded to find equation (7), $$\frac{V_{cav}}{i}=R\left(\frac{\omega_0 t}{2Q},\frac{\omega_0 t}{8Q^2}\right) \tag{7}$$

which has the same angular phase relationship of $$\angle\left(\frac{V_{cav}}{i}\right)=\frac{1}{4Q}$$

as the maximum asymptotic phase shift.

Figure 12:
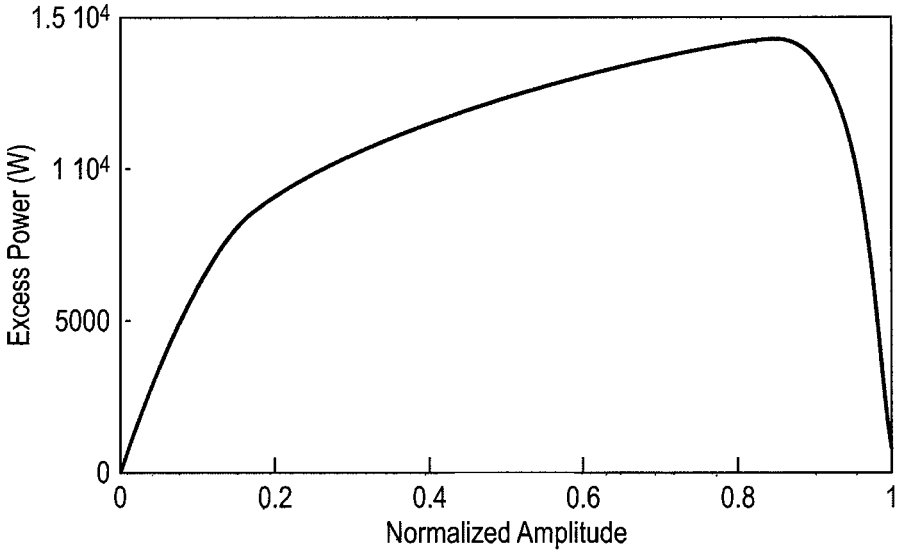
FIG. 12 shows a plot of excess power generated in the second resonant circuit as a function of cell voltage amplitudes relative to the design amplitudes, for the configuration B klynac shown in FIG. 2.

Because the linac cells may have high Q values and they dominate the second circuit's power, the Q of the second circuit may also be very high and this phase shift may be on the order of 0.1 mrad for the specific embodiment of a configuration B klynac as shown in FIG. 2. According to equation (7), for embodiments of the present invention it may be assumed that the circuit voltage and induced current are in phase at every point in the circuit ring up, allowing for simple calculations of the excess power generated by the beam at all amplitudes, as shown in FIG. 12. Here, the excess power is defined by the power extracted by the electron beam minus the ohmic losses in the second circuit. Because at all points during ring up the electron beam gives up more power than is needed to sustain the circuit fields at that amplitude, the amplitude may stably grow to the equilibrium level.

A klynac is a combined RF source (klystron) and linear accelerator (linac). It has a primary application as a radiation source, by converting a 1 MeV or higher energy electron beam to X-rays through a tungsten converter. Embodiments of the present invention may include a klynac with two resonant circuits (i.e., all the klystron and linac cells are resonantly coupled into one of two separate circuits).

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the spirit and scope of the present invention.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," "one of," and "selected from," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

A relevant device or component (or relevant devices or components) according to embodiments of the present invention described herein may be implemented utilizing any suitable hardware (e.g., an application-specific integrated circuit), firmware (e.g., a DSP or FPGA), software, or a suitable combination of software, firmware, and hardware. For example, the various components of the relevant device(s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Also, any numerical range recited herein is intended to include all sub-ranges of the same numerical precision subsumed within the recited range. For example, a range of "1.0 to 10.0" or between "1.0 and 10.0" is intended to include all sub-ranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such sub-ranges would comply with the requirements of 35 U.S.C. § 112, first paragraph, and 35 U.S.C. § 132(a).

Although this invention has been described with regard to certain specific embodiments, those skilled in the art will have no difficulty devising variations of the described embodiments, which in no way depart from the scope and spirit of the present invention. Furthermore, to those skilled in the various arts, the invention itself described herein will suggest solutions to other tasks and adaptations for other applications. It is the Applicant's intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents.

What is claimed is:

1. A klynac comprising:

a klystron input cell configured to form a first resonant circuit;

a klystron output cell coupled to the klystron input cell; and a plurality of linac cells coupled to the klystron output cell via one or more coupling cells and configured to form a second resonant circuit with the klystron output cell.

2. The klynac of claim 1, wherein the plurality of linac cells comprises four linac cells.

3. The klynac of claim 1, further comprising a klystron gain cell configured to be a part of the second resonant circuit.

4. The klynac of claim 3, wherein the klystron gain cell comprises two klystron gain cells.

5. The klynac of claim 3, wherein the klystron gain cell comprises three klystron gain cells.

6. The klynac of claim 1, further comprising a klystron gain cell configured to be a part of the first resonant circuit.

7. The klynac of claim 6, wherein the klystron gain cell comprises two klystron gain cells, and wherein the plurality of linac cells comprises four linac cells.

8. A klynac comprising:

a first klystron gain cell configured to form a first resonant circuit; and a second klystron gain cell, a klystron penultimate and output cell, and a plurality of linac cells configured to form a second resonant circuit, wherein the second klystron gain cell, the klystron penultimate and output cell are coupled to each other and to the first klystron gain cell, and the plurality of linac cells are coupled to the klystron penultimate and output cell via one or more coupling cells.

9. The klynac of claim 8, wherein the first klystron gain cell is also an input cell.

10. The klynac of claim 8, wherein the first klystron gain cell comprises two klystron gain cells.

11. The klynac of claim 8, wherein the second klystron gain cell comprises two klystron gain cells.

12. The klynac of claim 8, wherein the klystron penultimate and output cell comprises two klystron gain cells.

13. The klynac of claim 8, wherein the plurality of linac cells comprises four linac cells.

14. A klynac comprising:

a plurality of klystron cells comprising:

a klystron input cell configured to form a first resonant circuit;

a klystron gain cell coupled to the klystron input cell; and a klystron output cell coupled to the klystron gain cell; and a plurality of linac cells coupled to the klystron output cell via one or more coupling cells and configured to form a second resonant circuit with the klystron gain cell and the klystron output cell.

15. The klynac of claim 14, wherein the plurality of klystron cells have a gap length smaller than a length of coupling cells between adjacent ones of the plurality of klystron cells.

16. The klynac of claim 14, wherein a first linac cell of the plurality of linac cells have a different length and RF field amplitude than each of the other linac cells of the plurality of linac cells.

17. The klynac of claim 14, wherein the plurality of linac cells have a gap length longer than a length of coupling cells between adjacent ones of the plurality of linac cells.

18. The klynac of claim 14, further comprising an intercepting aperture between the klystron output cell and a first linac cell of the plurality of linac cells, the intercepting aperture being configured to reduce a beam current in the plurality of linac cells.

19. The klynac of claim 18, wherein a reduction amount of the beam current is adjustable by pinching the beam with an external magnetic field.

20. The klynac of claim 14, further comprising a coupling cell between the klystron output cell and a first linac cell of the plurality of linac cells, the coupling cell being a toroidal cell.

* * * * *